US005180446A

United States Patent [19]

Tsukuta et al.

[11] Patent Number: 5,180,446

[45] Date of Patent: Jan. 19, 1993

[54] OXIDE-DISPERSION-STRENGTHENED NIOBUM-BASED ALLOYS AND PROCESS FOR PREPARING

[75] Inventors: Kenji Tsukuta, Chita; Tomohito Iikubo, Nagoya, both of Japan

[73] Assignee: Daido Tokushuko Kabushiki Kaisha, Nagoya, Japan

[21] Appl. No.: 826,425

[22] Filed: Jan. 27, 1992

[30] Foreign Application Priority Data

Jan. 31, 1991 [JP] Japan ..... 3-11185

[51] Int. Cl.[5] ..... C22C 27/02

[52] U.S. Cl. ..... 148/422; 75/351; 75/622; 148/442; 419/66; 419/67; 419/68; 419/69; 420/426; 420/580; 420/588

[58] Field of Search ..... 148/422, 405, 407, 419, 148/442; 420/425, 426, 580, 901, 588; 75/351, 622; 419/66, 67, 68, 69

[56] References Cited

U.S. PATENT DOCUMENTS 3,028,236 4/1962 Wlodek et al. ..... 420/425

*Primary Examiner*—R. Dean
*Assistant Examiner*—Robert R. Koehler
*Attorney, Agent, or Firm*—Varndell Legal Group

[57] ABSTRACT

Improvement of Nb-alloys, which are known as heat-resistant alloys, by giving anti-oxidation property thereto and increasing the high temperature strength thereof. In addition to a determined amount of Al, one of (1) suitable amounts of Ti, Cr and V, and (2) suitable amounts of Cr and Co, are added to Nb-matrix, and a high melting temperature metal oxide such as $Y_2O_3$ or $Al_2O_3$ is dispersed in the matrix. Preferable method of preparing the alloys is combination of mechanical alloying and subsequent hot processing.

6 Claims, No Drawings

OXIDE-DISPERSION-STRENGTHENED NIOBUM-BASED ALLOYS AND PROCESS FOR PREPARING

BACKGROUND OF THE INVENTION

1. Field of the Invention

The present invention concerns an oxide-dispersion-strengthened niobium-based alloy having both good oxidation resistance and good heat resistance.

2. State of the Art

Niobium is one of the high-melting point metals (m.p. 1467° C.) and niobium-based alloys are often used as the material of the parts to be exposed to a temperature as high as 1400° C. or more. The niobium-based alloys having high strength at a high temperature, however, have low oxidation resistance, and cannot be used in an oxidizing atmosphere. Though niobium-based alloys with improved oxidation resistance have been developed, strength of the known alloys at high temperatures is still low. Thus, the conventional niobium-based alloys are not satisfactory as the material for structural parts.

There has been proposed a countermeasure to overcome the above problem, which comprises preparing a part with the above noted niobium-based alloy with high strength at high temperatures and coating the surface thereof with powder having oxidation resistance. If, however, the oxidation resisting coating loses the protecting ability due to some reasons such as crack formation in the coating while the part is used or abrasion in case of a sliding member, the niobium-based metals are seriously damaged.

SUMMARY OF THE INVENTION

An object of the present invention is to solve the above noted problem by providing niobium-based alloys having good high temperature strength and is resistant to oxidation in an oxidizing atmosphere. To provide a process for preparing the niobium alloy is also an object of the invention.

An embodiment of the oxide-dispersion-strengthened niobium-based alloys with good oxidation resistance and heat resistance according to the invention consists essentially of Al: 12–35 wt. %, Ti: 7–28 wt. %, Cr: 2–10 wt. % and V: 2–10 wt.%, and the balance of Nb, in which 0.1–2 wt. % of a high melting point metal oxide is dispersed.

Another embodiment of the alloy consists essentially of Al: 10–35 wt. %, Cr: 15–35 wt. % and Co: 10–25 wt. % and the balance of Nb, in which 0.1–2 wt. % of a high melting point metal oxide is dispersed.

Typical high melting point metal oxides are $Y_2O_3$, $Al_2O_3$, $CeO_2$ and $Gd_2O_3$. Yttria, $Y_2O_3$, is the most useful.

A process for preparing the oxide-dispersion-strengthened niobium-based alloy with good oxidation resistance and heat resistance according to the invention comprises mixing 0.1–2 wt. % of a high melting point metal oxide to an alloy of one of the above defined alloy compositions or a mixture of metals giving the above alloy compositions; treating the obtained mixture by mechanical alloying method to produce the alloy powder; and hot processing the produced alloy powder to a part of the desired shape.

DETAILED EXPLANATION OF THE PREFERRED EMBODIMENTS

The mechanical alloying method is a technology to obtain a particle product consisting of intimate and uniform mixture of very fine powders of the alloy components by treating particles of pure metals or alloy components to form the product alloy and fine crystals of an oxide having a high melting point such as yttria, $Y_2O_3$, in a ball mill, typically, a high kinetic energy type ball mill, to perform crushing accompanied by welding repeatedly.

As the hot processing technology subsequent to the treatment by mechanical alloying, there will be carried out HIP (hot isostatic pressing), hot extrusion, vacuum hot pressing and combination of forging with one of the above processes.

The reasons for limiting the alloy compositions of the present oxide-dispersion-strengthened niobium-based alloys as recited above are explained below:

Al: 12–35 wt. %

For the purpose of improving oxidation resistance of the niobium-based alloys the present invention utilizes protecting effect of $Al_2O_3$ coating film. In order to form solid and uniform coating film on the alloy product, at least 12 wt. % of Al is essential. However, increase of Al-content lowers the melting of the alloy, addition is limited to 35 wt. % or less so as to ensure the heat resistance.

Ti: 7–28 wt. %; Cr: 2–10 wt. %; V: 2–10 wt. %

These elements used in the first embodiments of the present alloys are capable of reducing critical Al-content necessary for the formation of $Al_2O_3$ coating film by decreasing the diffusion coefficient of the oxygen ions in the alloy. If the rate of diffusion of the oxygen ions is large, the oxygen atoms inveded at the surface of the alloy product will rapidly diffuse into the inner part, and it will be difficult to achieve the intension to form $Al_2O_3$ coating film on the surface of the product. Thus, there will be undesirable disadvantage that metal components at the surface will be oxidized and the resulting oxide films fall down. As noted above, addition of Al causes lowering of the melting point, it is preferable to efficiently form $Al_2O_3$ with Al of the amount as small as possible. The above explained effect of Ti, Cr and V is not appreciable when the contents thereof are less than the above limits. On the other hand, too much addition will lower the melting point of the alloy. Cr: 15–35 wt. %; Co: 10–25 wt. %

The elements used in the second embodiments, like the Ti, Cr and V used in the first embodiment, lower the diffusion coefficient of oxygen ions. Co of a suitable content will contribute to improvement of high temperature strength. The reasons for limiting the composition are as set forth in the explanation of the first embodiment.

High melting point metal oxide such as $Y_2O_3$ and $Al_2O_3$: 0.1–2 wt. %.

Needless to say, the oxide such as yttria, alumina and other metal oxides are dispersed in the niobium-based alloys to increase the high temperature strength thereof. The effect can be obtained when 0.1 wt. % or more is added, slows down around 1 wt. %, and almost saturates at 2 wt. %.

The above explained mechanical alloying method is effective for uniformly dispersing $Y_2O_3$ or other metal oxide in the matrix of niobium-based alloys, and the uniform dispersion results in formation of $Al_2O_3$ in the form of wedges which anchor in the surface of the product and remain rigidly thereon.

The present invention realizes both good heat resistance and the good oxidation resistance, which have been considered inconsistent. As the result, it is now possible to use various members made of the present oxide-dispersion-strengthened niobium-based alloy at a high temperature exceeding 1,400° C. Example of the uses of the present alloy are burner cylinders of jet engines, zigs for the tests at extremely high temperature, and fasteners (bolts and nuts) for carbon panels on the surfaces of space shuttles. Further, high temperature members which are currently made of ceramics may be replaced with a the niobium-based alloy of the invention to increase the strength and improve the reliability of the members.

EXAMPLE 1

Niobium-based alloys of the compositions shown in TABLE 1 (weight %, the balance being Nb) were prepared by mechanical alloying (in accordance with the invention) or by melting (conventional process) for comparison.

TABLE 1

| | Al | Cr | V | Ti | $Y_2O_3$ | $Al_2O_3$ | $CeO_2$ | $Gd_2O_3$ |
|---|---|---|---|---|---|---|---|---|
| Invention 1 | 22.2 | 3.1 | 4.0 | 23.4 | 0.6 | — | — | — |
| Invention 2 | 22.3 | 3.2 | 4.0 | 23.5 | — | 0.6 | — | — |
| Invention 3 | 22.0 | 3.1 | 4.1 | 23.2 | — | — | 0.6 | — |
| Invention 4 | 22.3 | 3.0 | 4.2 | 23.1 | — | — | — | 0.6 |
| Invention 5 | 22.1 | 3.2 | 4.1 | 23.2 | 0.3 | 0.3 | — | — |
| Invention 6 | 22.2 | 3.0 | 4.0 | 23.2 | 0.3 | — | 0.3 | — |
| Invention 7 | 22.1 | 3.2 | 4.2 | 23.3 | 0.3 | — | — | 0.3 |
| Comparison 1 | 22.1 | 3.0 | 4.0 | 23.5 | — | — | — | — |

The samples were subjected to the following tests:

| | |
|---|---|
| (creep rupture test) | 1,500° C., stress 10.5 kgf/mm$^2$ |
| (oxidation test) | 1,300° C., in air |

The test results are as shown TABLE 2:

TABLE 2

| | Rupture Life (hrs) | Oxidation Loss (mg/cm$^2$) 50 hrs | 100 hrs | 500 hrs |
|---|---|---|---|---|
| Invention 1 | 85 | 5 | 12 | 15 |
| Invention 2 | 80 | 7 | 15 | 18 |
| Invention 3 | 82 | 6 | 13 | 19 |
| Invention 4 | 83 | 7 | 14 | 20 |
| Invention 5 | 82 | 5 | 14 | 22 |
| Invention 6 | 84 | 7 | 15 | 19 |
| Invention 7 | 85 | 5 | 14 | 20 |
| Comparison 1 | 8 | 50 | 153 | 425 |

EXAMPLE 2

Niobium-based alloys of the compositions shown in TABLE 3 (weight %, the balance being Nb) were prepared, as carried out in Example 1, by mechanical alloying (invention) or by melting (comparison), and the samples were evaluated as done in Example 1.

TABLE 3

| | Al | Cr | Co | $Y_2O_3$ | $Al_2O_3$ | $CeO_2$ | $Gd_2O_3$ |
|---|---|---|---|---|---|---|---|
| Invention 8 | 10.0 | 19.3 | 15.2 | 0.6 | — | — | — |
| Invention 9 | 10.1 | 19.4 | 15.3 | — | 0.6 | — | — |
| Invention 10 | 10.0 | 19.5 | 15.5 | — | — | 0.6 | — |
| Invention 11 | 10.1 | 19.4 | 15.3 | — | — | — | 0.6 |
| Invention 12 | 10.4 | 19.6 | 15.4 | 0.3 | 0.3 | — | — |
| Invention 13 | 10.0 | 19.5 | 15.1 | 0.3 | — | 0.3 | — |
| Invention 14 | 10.1 | 19.6 | 15.2 | 0.3 | — | — | 0.3 |
| Comparison 2 | 10.2 | 19.3 | 15.3 | — | — | — | — |

The test results are as shown in TABLE 4:

TABLE 4

| | Rupture Life (hrs) | Oxidation Loss (mg/cm$^2$) 50 hrs | 100 hrs | 500 hrs |
|---|---|---|---|---|
| Invention 8 | 83 | 8 | 18 | 24 |
| Invention 9 | 81 | 10 | 20 | 26 |
| Invention 10 | 80 | 11 | 19 | 27 |
| Invention 11 | 81 | 12 | 20 | 26 |
| Invention 12 | 79 | 10 | 21 | 25 |
| Invention 13 | 78 | 10 | 22 | 26 |
| Invention 14 | 80 | 11 | 23 | 28 |
| Comparison 2 | 5 | 57 | 167 | 478 |

We claim:

1. An oxide-dispersion-strengthened niobium-based alloy with good oxidation resistance and heat resistance, which consists essentially of Al: 12–35 wt. %, Ti: 7–28 wt. %, Cr: 2–10 wt. % and V: 2–10 wt. %, and the balance of Nb, in which 0.1–2 wt. % of a high melting point metal oxide is dispersed.

2. An oxide-dispersion-strengthened niobium-based alloy according to claim 1, wherein the high melting point metal oxide is selected from $Y_2O_3$ and $Al_2O_3$.

3. A process for preparing an oxide-dispersion-strengthened niobium-based alloy with good oxidation resistance and heat resistance, comprising mixing 0.1–2 wt. % of a high melting point metal oxide to an alloy consisting essentially of Al: 12–35 wt. %, Ti: 7–28 wt. %, Cr: 2–10 wt. % and V: 2–10 wt. %, and the balance of Nb, or a mixture of metals giving the above alloy composition; treating the obtained mixture by mechanical alloying method to produce the alloy powder; and hot processing the produced alloy powder to a part of the desired shape.

4. An oxide-dispersion-strengthened niobium-based alloy, which consists essentially of Al: 10–35 wt. % Cr: 15–35 wt. % and Co: 10–25 wt. % and the balance of Nb, in which a high melting point metal oxide in an amount of 0.1 to 2 wt. % is dispersed.

5. An oxide-dispersion-strengthened niobium-based alloy according to claim 4, wherein the high melting point metal oxide is selected from $Y_2O_3$ and $Al_2O_3$.

6. A process for preparing an oxide-dispersion-strengthened niobium-based alloy with good oxidation resistance and heat resistance, comprising mixing 0.1–2 wt. % of a high melting point metal oxide to an alloy consisting essentially of Al: 10–35 wt. %, Cr: 15–35 wt. % and Co: 10–25 wt. %, and the balance of Nb, or a mixture of metals giving the above alloy composition; treating the obtained mixture by mechanical alloying method to produce the alloy powder; and hot processing the produced alloy powder to a part of the desired shape.

* * * * *